United States Patent [19]

Chou et al.

[11] Patent Number: 4,839,224

[45] Date of Patent: Jun. 13, 1989

[54] THERMAL TRANSFER RECORDING MATERIAL CONTAINING CHLORINATED PARAFFIN WAX

[75] Inventors: Hsin-hsin Chou; Wu-Shyong Li, both of St. Paul, Minn.

[73] Assignee: Minnesota Mining and Manufacturing Company, St. Paul, Minn.

[21] Appl. No.: 255,320

[22] Filed: Oct. 11, 1988

[51] Int. Cl.[4] ..... B41M 5/20

[52] U.S. Cl. ..... 428/323; 428/195; 428/484; 428/488.1; 428/913; 428/914

[58] Field of Search ..... 428/195, 323, 484, 488.1, 428/488.4, 913, 914

[56] References Cited

U.S. PATENT DOCUMENTS

| | | | |
|---|---|---|---|
| 3,601,484 | 8/1971 | Dybvig et al. | 355/4 |
| 3,736,133 | 5/1973 | Weigl et al. | 96/1.5 |
| 4,476,179 | 10/1984 | Moriguchi et al. | 428/216 |
| 4,502,065 | 2/1985 | Moriguchi et al. | 346/204 |
| 4,503,095 | 3/1985 | Seto et al. | 427/265 |
| 4,572,684 | 2/1986 | Sato et al. | 499/240.4 |

FOREIGN PATENT DOCUMENTS

| | | |
|---|---|---|
| 0163297 | 12/1985 | European Pat. Off. . |
| 58-162678 | 9/1983 | Japan . |

OTHER PUBLICATIONS

"Thermal Ink Transfer Sheets for Gradated Print-"-Taguchi et al., (pp. 323–325).

Derwent Abstracts dated Oct. 4, 1988, p. 6, JP56 030892.

*Primary Examiner*—Ellis P. Robinson

*Assistant Examiner*—P. R. Schwartz

*Attorney, Agent, or Firm*—Donald M. Sell; Walter N. Kirn; Mark A. Litman

[57] ABSTRACT

A novel donor construction is used for thermal mass transfer imaging applications. The donor constructions are coated from pigment dispersions which are flushed in solutions containing a chlorinated wax. Because of near refractive index matching to the coloring pigments and the low cohesive strength of the chlorinated wax, this novel thermal mass transfer system is characterized by low transfer energy requirements and high transparency in the transferred images.

16 Claims, No Drawings

THERMAL TRANSFER RECORDING MATERIAL CONTAINING CHLORINATED PARAFFIN WAX

BACKGROUND OF THE INVENTION

1. Field of the Invention

The present invention relates to thermal image transfer systems, and to donor sheets useful in such systems, and to a process for thermally transferring images.

2. Background of the Art

Many imaging systems have been developed to be used with computer generated and other electronically generated images. This development has been necessitated by the generation or transmission of electronic images and the need for hard copy prints of such images, both in black and white and color. Originally silver halide imaging systems were used for such image generation, and such systems still can provide high quality images. In certain areas of the market, lower image quality can be tolerated and lower costs are essential. Ink-jet printing and thermal dye transfer systems have found increasing acceptance in these markets.

Ink jet printing has suffered in its acceptance because of a number of technical problems, not the least of which is a tendency of print heads to clog. This requires an intolerable level of maintenance and a complete shut down of the system during servicing. Furthermore, image colors tend to be unstable and color gradation has been virtually non-existant. Color gradation has been quite limited in commercial thermal colorant transfer systems, although significant improvements in these problems have been made.

The technology of thermal colorant systems can be divided into two fields, mass transfer and dye sublimation transfer. The term mass transfer is used to refer to systems in which both the colorant and its binder are transferred from a donor sheet to a receptor sheet (or intermediate carrier sheet). Because of the relatively large size of the transferred material, (a particle comprising both colorant and binder), color gradation or continuous tones in the image is difficult to achieve. Furthermore, if the colorant is a dye it exhibits more limited aging stability than do pigments.

The term sublimation transfer is used to refer to systems in which essentially only the colorant is transferred by sublimation or vaporization to a receptor sheet. This type of process leaves behind in the donor sheet any binder which might have been used in the donor sheet.

In the mass transfer technology area such improvement has been made in the design and thermal control of the print head. A good example of this approach is is given by S. Merino of Matsushita Electric Company, Ltd. in a paper presented at the August '86 SPSE Conference on Non-Impact Printing Technologies in San Francisco. He described "thermo-convergent ink transfer printing (TCIP) as a system in which the shape of the heating elements of the print head are optimized and the energy pulses are controlled so that half-tone or approximately continuous tone reproduction is much improved when wax-colorant donor sheets are used. Understandably the donor sheet has been the target of improvement work in recent years. Japanese Kokai, J59-224394 discloses the use of two imcompatable binders in which the dye is dissolved. This results in the mass transfer of relatively small particles of colorant. Combining this donor sheet with good print head control is reported to give some low level of color gradation.

European Patent, EPO 163297 teaches the use of high melting-point particles with diameters larger than the thickness of the ink layer which particles serve as heat conductors to aid in the transfer of the color mass.

A paper entitled "Thermal Ink Transfer Sheets for Gradated Print" by Tagushi et al, of Matsushita given at the SPSE Conference in San Francisco on Aug. 24–26, 1986 briefly described a system claimed to yield improved mass transfer quality. This system makes use of one resin and colorant in the donor sheet and a different resin in the receptor sheet. The modulated thermal signal in the print-head causes changes in the "melt, compatibility, adhesion and transfer between the two resins" thus producing a continually graduated print.

Japanese Patent JP 62-292483 discloses a thermal transfer sheet having a thermal transfer layer which comprises a mixed wax of at least two components and a colorant. The layer comprises at least 60% by weight of the combination of waxes having a melting point in the range of 45°–70° C. and another thermal melting material having a softening point within the range of 100°–200° C. Neither of these materials are shown to include chlorinated waxes. However, an optional third ingredient, other waxes that may be mixed with A and B, includes amongst the more than thirty alternatives "chlorinated paraffin wax" (page 8 of translation). The system therefore requires that at least 60% of all thermally softenable materials be other than the chlorinated wax alternative.

Japanese Patent, JP 58-162678 discusses an ink containing chlorinated paraffin wax, and is used for a thermal transfer ink which is coated on paper. The use of the chlorinated paraffin wax is noted for improved shelf-life characteristics for the thermal transfer coating. There is no mention of improved transparency or clarity of colors.

U.S. Pat. No. 4,503,095 and U.S. Pat. No. 4,572,684 discuss a thermal transfer ribbon composition that contains a coloring agent and a hot-melt vehicle for a thermal transfer composition. These patents disclose that the coloring agent and the hot-melt vehicle used in each ink layer preferably should have refractive indexes which are near to each other. These patents do not mention the use of chlorinated paraffin waxes.

U.S. Pat. No. 3,736,133 discusses a method of forming ink absorbent transparencies comprising applying a lacquer to a polymeric film transparency, said lacquer comprising a substantially transparent resinous binder pigmented with an ink absorptive pigment exhibiting substantially the same refractive index as that of the binder, and drying said lacquer on said transparency. The pigment contains an ink absorptive pigment with high effective surface area which has a refractive index closely matching that of the binder in which it is to be used. Pigments specified match a certain range of near refractive index qualified resins, but they must also have the property of having an exceptionally high absorptive power for inks.

U.S. Pat. No. 3,601,484, Dybvig, et. al., discloses that configurations for carrier or donor sheet size can be in exact line up with the receptor sheet size. Also, Great Britain patents 1,278,325, 1,281,859, and 1,281,860 clearly detail elongate web material coated in sequential color arrangements, and each color zone being of equal size to the color separation image to be reproduced.

This configuration is discussed in more exact size arrangement in U.S. Pat. No. 4,503,095,

SUMMARY OF THE INVENTION

The present invention relates to a thermal colorant transfer system which reduces the major limitations of the thermal mass/dye transfer, namely low levels of color gradation, poor dye image color stability, and high energy thermal transfer requirements. This is accomplished by constructing a donor sheet consisting of a fine pigment dispersion in a chlorinated wax and other additives on a non-porous substrate.

The coating medium consists of a dispersion of submicron size, colorant particles in an organic medium. The colorant may be a pigment, a dye, a polymeric dye, or any combination of the three. The resin used in the coating medium in greatest proportion is a chlorinated paraffin wax, and additionally as required a natural wax, petroleum wax, synthetic wax, chlorinated rubber, chlorinated polyethylene, and/or other synthetic or natural resins. Preferred resins are chlorinated paraffin waxes of at least 30% chlorination content.

Characteristics of the chlorinated wax include chlorine content of at least 40%, softening point of greater than 100° C., preferably 110°-200° C. (Ball and Ring method, ASTM D-36), generally providing a refractive index (at 25° C.) of greater than 1.49, and molecular weight of at least 500.

Thermal colorant transfer donor sheets prepared according to this invention exhibit several advantages over wax/dye systems in that they yield color images of superior quality, transparency, color gradation, and abrasion resistance. Compared to dye sublimation systems, the present invention requires less transfer energy and gives a more stable image.

DETAILED DESCRIPTION OF THE INVENTION

This invention relates to a thermal transfer recording medium capable of developing highly transparent images for use in the thermal transfer recording system of the heat-meltable transfer type used with a thermal head printer. Thermal printers using such materials are useful in a variety of applications including facsimile, printer plotters, and computer output terminals. As office technology advances, low cost terminal printers appear to be good candidates for communicating terminals, allowing monochrome or color hard copy outputs. The benefits of these priners are clean operation, compactness, speed, reliability, and low cost. Thermal printers can be direct or transfer systems. In a direct system a thermal sensitive coated paper is heated selectively, causing a color change in the coating. In a transfer type printer, a donor ribbon or sheet coated with an ink composition is positioned intermediate to a thermal print head and a receptor sheet, preferably a plain paper sheet. The thermal print head is activated to supply heat selectively to the donor sheet causing melting and transfer of the heat meltable ink composition onto the paper in an image configuration. The heated portion of the donor film is melted and wets the receptor sheet or substrate. Subsequent separation of the sheets allows transfer of the ink to the image areas of the plain paper.

The conventional donor sheet comprises a support having coated thereon a heat-meltable ink comprising an organic pigment, a binder, a wax and other additives. Coating of the ink composition may be carried out by a variety of coating techniques such as gravure or flexographic coating methods. The wax of the ink composition is coated in a heat melted state. When heat is applied to the donor sheet by a thermal head, heat is transferred from the support to the coated layer and the ink of the areas contacted by the thermal head is transferred to the receiving sheet.

One aspect of the invention is to provide a thermal transfer donor sheet having a heat meltable ink layer on a non-porous support. The ink composition is transferable to a recieving sheet. Said donor sheet comprises:

(1) a non-porous substrate, having coated thereon, (2) a substantially transparent heat meltable ink layer, said transparent ink layer comprising a chlorinated paraffin wax binder and a pigment exhibiting a similar or substantially the same refractive index as that of the binder (e.g., preferably within 0.16 units, more preferably within 0.05 units). The chlorinated paraffin wax is characterized by having a chlorination content of 40-75%, preferrably 60-75%, a softening point of greater than 100° C., and preferably 110° C. or 120° C. to 200° C., and a molecular weight of at least 400 or 500-2000.

The donor sheet contains in the heat meltable ink layer preferably 5 to 85% (usually 5 to 45%) by weight of a finely dispersed colorant, 10 to 90% by weight of a highly chlorinated wax, and additionally as necessesary preferably 0 to 50% additional binder and preferably the pigments comprise at least one of yellow, cyan, magenta, black and/or white pigments.

The thermal transfer donor sheet of the present invention has much improved transparency over conventional thermal transfer materials. This is accomplished by the combination of coloring materials of significantly small particle size, and use of resin or binder with a refractive index near that of the coloring material. Colorants used herein are conventionally used pigments, and binders comprise chlorinated paraffin waxes.

Transparency (clarity) of the image us a highly desired property for thermal transfer media. Transparency can be achieved as previously mentioned by the use of highly dispersed pigments in the heat meltable resin/-binder system, and closely matching the refractive index of the pigment to a resin or binder. Transparency in general means that light is capable of passing through an object, rather than being scattered or dispersed. The way different objects reflect, refract or, absorb light gives an object individual color and appearance.

Transparency can be achieved by the use of highly dispersed pigments in a binder system wherein so little scattering of light occurs that the resultant colors are completely transparent. Billmeyer and Saltzman in "Principles of Color Technology" second edition, John Wiley & Sons, New York, p. 8, describe transparency as also requiring in addition to an excellent dispersion, that the resin and pigment having similar indices of refraction. When the two have the same index of refraction, no light is scattered, and they appear as transparent.

For this reason the choice of heat meltable binder and colorants of near refractive index should give superior transparency for the thermal transfer media of the present invention. U.S. Pat. No. 4,503,095 mentions the use of color agents and vehicles having near refractive indices for transparency but does not teach how this is accomplished. U.S. Pat. No. 4,651,177 mentions the use of chlorinated paraffin wax as one of a series of synthetic waxes for a nonlimiting example of waxes in a thermal transfer donor material. The patent does not specify any specific contribution to transparency, nor specifically describe a definite chlorine content. Japanese patent JP 58-162678 discusses the use of a paraffin chloride for use as a wax component in a thermal transfer recording ink. It specifies the chlorinated wax as having a melting point or softening point of 40°–100° C. The amount to be admixed is 30–90% by weight of the ink. The choice of the chlorinated wax is not mentioned as having any particular contribution to transparency or refractive index. The addition of the paraffin chloride is disclosed as giving the formulation better stability for shelf-life.

Chlorinated paraffin waxes are well known in the literature, and have been previously mentioned as used in thermal tranfer type applications, but no prior art has been cited teaching the use of refractive index matching with colorants for greater transparency. It has been found that higher refractive indices are produced in the waxes by higher chlorination levels so that the refractive indices of the wax and colorants may be more nearly matched to provide a transparent donor sheet. Higher chlorination levels also provide higher softening temperatures and glass transition temperatures for the waxes. Softening temperatures well in excess of 100° C. (i.e., at least 110° C. and preferably at least 120° C.) must be used to gain the advantages of higher refractive indices.

Chlorinated paraffins are defined as hydrocarbons having the general formula $C_xH_{(2x-y+2)}Cl_y$, where y is at least 1. Ratios of Cl/H of up to about 1:1 can be found commercially. The ratio is usually lower than 1:2. Raw materials used in the chlorination of paraffins consist of petroleum fractions such as normal paraffins being at least 98% linear, and wax fractions having as many as twenty-four carbon atoms. Selection of raw material is dependent upon the desired property of the finished chlorinated paraffin.

Paraffin waxes have very similar compositions. Melting point is one property which does vary. Differences in melting points of commercial paraffin waxes vary due to differences in their molecular weight and oil content. In solid solutions of wax, melting points lie between the melting points of the wax components. Unmodified paraffin wax does not have a sharp melting point, it has a temperature known as a transition point. Studies of the transition point of paraffin waxes from a practical aspect are not definitely established yet. It has been shown that waxes showing indistinct transitions or no transition points are more translucent than those in which the transition is marked.

Preferred waxes are generally hydrocarbon waxes (with some degree of oxygen allowably present, e.g., as esterification) usually saturated alkanes, generally having melting points between 30° and 100° C., such as paraffin, carnauba, bees wax, microcrystalline waxes, Candelilla, etc.

It has also been amply demonstrated that different types of hydrocarbons exhibit different relationships between melting point and refractive index. In groups of hydrocarbons having the same melting point, the normal alkane exhibits the lowest refractive index; progressive branching raises the refractive index, and chlorination of the wax raises the refractive index even more.

Commercial chlorinated paraffins have a 20–75% chlorine range. The majority of commercially available chlorinated paraffin waxes fall within the 40–70% Cl range. Table I contains a listing of commercially available chlorinated paraffins by their chlorine content.

TABLE I

| | | Commercial Chlorinated Paraffins | | | |
|---|---|---|---|---|---|
| | | Manufacturer | | | |
| Chlorine Content, % | Average Molecular Formula | Occidental Chemical Corp. | Keil Chemical | Dover Chemical | Plastifax |
| 40–42 | $C_{24}H_{44}Cl_6$ | Chlorowax 40 | CW-170 | Paroil 140 | Plastichlor 42-170 |
| 48–54 | $C_{24}H_{42}Cl_8$ | Chlorowax 50 | CW-200-50 | Paroil 150S | Plastichlor 50-220 |
| 70 | $C_{24}H_{29}Cl_{21}$ | Chlorowax 70 | | Chlorez 700 | |
| 50–52 | $C_{15}H_{26}Cl_6$ | | | Paroil 1048 | |
| 60–65 | $C_{12}H_{19}Cl_7$ | Chlorowax 500C | CW-86-60 | Paroil 160 | Plastichlor P-59 P-65 |
| 70 | $C_{12}H_{15}Cl_{11}$ | Chlorowax 70L | CW-200-70 | Paroil 170HV | Plastichlor P-70 |

Chlorinated waxes of choice are commercially available materials, both liquid and resinous products, which are derived from the carefully controlled chlorination of paraffin waxes and liquids. As a group, they are noted for non-flammability and general chemical inertness. These products are insoluble in water and the lower alcohols and glycols, and have a wide range of compatibility and solubility with most organic solvents, resins, and plastics. They can be processed up to 325° C. depending on processing temperature and conditions.

Chlorinated paraffins particularly suitable for use in the present invention are those of molecular weight in the range of 500 to 2000 which contain from 40 to 75% weight chlorine to the total weight of the wax. Presently preferred chlorinated paraffins contain 60 to 75% weight percent chlorine, have a molecular weight in the range of 500 to 2000, and a softening point within the range of 100° C. to 200° C. Such compounds are commercially available and are produced by the chlorination of selected paraffin wax and liquid paraffinic fractions. Table II contains a listing of typical properties of chlorinated paraffins.

TABLE II

| Physical Properties of Chlorinated Paraffins | | | | | | |
|---|---|---|---|---|---|---|
| Paraffin Feedstock | Wax | | | $C_{13}$–$C_{17}$ | | $C_{10}$–$C_{13}$ |
| Chlorine Content, % | 39 | 42 | 48 | 70–75 | 52 | 60 |
| Density at 25° C., g/mL | 1.12 | 1.17 | 1.23 | 1.65 | 1.25 | 1.36 |

TABLE II-continued

| Physical Properties of Chlorinated Paraffins | | | | | | |
|---|---|---|---|---|---|---|
| Paraffin Feedstock | Wax | | | $C_{13}$-$C_{17}$ | | $C_{10}$-$C_{13}$ |
| Viscosity at 25° C., Pa's* | 0.7 | 3.0 | 12.5 | solid | 1.6 | 3.5 |
| Color (Gardner) | 2 | 2 | 2 | white | 1 | 1 |
| Refractive Index | 1.501 | 1.505 | 1.516 | 1.535 | 1.510 | 1.516 |
| Heat Stability, % HCl after 4 h at 175° C. | 0.2 | 0.2 | 0.25 | 0.15 | 0.10 | 0.10 |

*To convert Pa's to poise, multiply by 10

Specific examples of the chlorinated waxes of choice are chlorinated waxes available from Occidental Chemical Corp., Irving, Tex., and Dover Chemical Corp, Dover, Ohio, under the name of "CHLOROWAX" and "CHLOREZ", respectively. Both liquid and resinous forms of CHLOROWAX show excellent compatibility with many types of synthetic and natural organic materials including vegetable oils, synthetic polymers and waxes.

Liquid and resinous chlorinated paraffin products are inert and have various viscosities and chlorine contents. These specified chlorinated paraffin resins have high indexes of refraction. Chlorinated wax products typically have indices of refraction in the range of 1.500–1.550. These chlorinated waxes are each used alone or in mixtures with other waxes (chlorinated or not chlorinated) or compatible resins or polymers, which after adjusting the melting point or transition point, have softening points in the range of from 110° to 200° C., preferably 110° to 200° C., more preferably 120° to 200° C. The amount of chlorinated wax in the ink layer is preferably in the range of from 50 to 95% by weight. If the amount is less than 50% by weight, the amount of transferred ink becomes insufficient to produce sufficient image density, whereas if the wax amount exceeds 95% by weight, the image density becomes also insufficient for practical use because of dilution of the pigment even though the transferred amount of the ink is increased.

The proportion of optional binder in the ink layer is generally in the range of 0 to 20% by weight. Typical examples of binders useful in present invention are other waxlike materials such as paraffin waxes, silicones, natural waxes such as beeswax, Candelilla wax, Japan wax, carnauba wax, and ozocerite. Synthetic waxes are also useable, especially acid waxes, ester waxes, partially saponified ester waxes, and polyethylene waxes, polyvinyl alcohol, methylcellulose, gelatin, hydroxymethylcellulose, gum arabic, starch and derivatives therof, casein, polyvinylpyrrolidone, styrene-butadiene copolymer, coumarin-indene resin, polyvinylacetate, vinylacetate copolymers, methyl methacrylate resin, acrylic resin, styrene-acrylonitrile resin, ethylene-vinyl acetate copolymer, and chlorinated rubber or polyolefin. These may be used alone or in combinations of two or more.

The ink composition of the present invention uses finely dispersed pigments for the ink colorant. Among finely dispersed pigments are pigments that are flushed. Flushed pigments are a type of pigment that has been precipitated in an aqueous phase to a non-aqueous phase, especially wherein the dry particle (aqueous or water-wet pigment phase) is mixed and agitated with a nonaqueous vehicle (oil solvent, and/or resin phase) in a heavy duty mixer. The pigment particles are flushed or preferentially transferred to the aqueous phase and the bulk of the essentially clear water is poured off. These pigments provide superior brilliancy and transparency, lay well on paper, and provide ease of dispersion formulations. For these reasons, use of flushed pigments is preferred for the ink compositions of the present invention.

They are also preferred due to their properties of retention of fine particle structure in the formulation of the thermal transfer materials of the present invention.

The pigments used in present donor sheet construction include pigments and solvent soluble dyes. A dispersion of fine particle size of about 0.8 microns and below and preferably 0.5 microns or below, and 0.2 microns and below is preferred.

Colorants used for example in the present invention are Chrome Yellow, Zinc Yellow, Lemon Yellow, Cadmium Yellow, Naphthol Yellow S, Hansa Yellow 5G, Hansa Yellow 3G, Hansa Yellow G, Hansa Yellow GR, Hansa Yellow A, Hansa Yellow RN, Hansa Yellow R, Benzidine Yellow, Benzidine Yellow G, Benzidine GR, Permanent Yellow NCG, Quinoline Yellow Lake, Permanent Red 4R, Brilliant Fast Scarlet, Brilliant Carmine BS, Permanent Carmine FB, Lithol Red, Permanent Red F5R, Brilliant Carmine 6B, Rhodamine Lake Y, Alizarine Lake, Victoria Lake Blue, metal-free Phthalocyanine, Phthalocyanine Blue, and Fast Sky Blue.

The proportion of the pigment in the heat meltable layer is generally 5 to 85%, preferably 5 to 45% by weight.

The heat transfer composition of the present invention can further have a white color in addition to the cyan, yellow, and magenta colors for the purpose of pre-printing on the rough surface receptor, and to improve the transferred image quality of the yellow, magenta, or cyan. The white coloring ink composition is formed from an ink composition containing $TiO_2$ or opacifying fillers, waxes, and resinous binders.

The supports used in the donor sheet of this invention include non-porous paper such as capacitor tissue paper, typewriter manifold, or tracing paper, synthetic paper, cellophane, and polymeric resin films such as polyester film, polyimide film, polyethylene film, polycarbonate film, polystyrene film, polyvinylacetate film, polyvinylalcohol film, polyvinylethylene, and polypropylene film. These support materials can be used as non-treated substrates, or heat treated substrates to prevent sticking by the thermal head. The preferred examples of the substrates have a thickness of about 3 microns.

The term "non-porous" is indicative of the fact that when heated, the wax material will not substantially be absorbed or will not retract into the substrate. Some imageable materials work by forming holes or areas where transferable material is not present because of its absorption into the substrate. Here the substrate is so thin it is effectively non-porous in that the wax coating will not penetrate into the substrate in such a volume as to prevent transfer of most of the coating where heated.

Coating of the thermal transfer material can be by conventional known coaters such as knife, roll coater, blade coater, spin coater, and bar coater. Known coating processes of the gravure and flexographic types can also be used. To produce a full color image of at least three colors of yellow, magenta, and cyan, each color is partially and successively printed linewise, areawise, and dotwise on the same support.

Formation of the heat-meltable color layers is achieved by coating the layers in transverse alignment to the coated web and or in stripes having sequential color arrangements traverse to the coated web.

The present invention is further explained by the following non-limiting examples. Flushed pigment pastes were obtained from Sun Chemical Co. Frequently used colors were AAA Yellow (C.I. 21105), Lithol Rubine (C.I. 15850), and G.S. Phthalo Blue (C.I. 74160) for yellow, magenta, and cyan, respectively. To prepare donors, flushed colored pigments were dissolved in toluene to give a 6–9 weight percent dispersion, and further dispersed by a Bronson sonnicator for five minutes. Very stable dipersions were obtained. Chlorinated paraffins, Chlorowax 70 and Chlorowax 50, and a low melting point beeswax, each, respectfully, were also dispersed in toluene to make up 6% solutions.

EXAMPLE 1

Each flushed pigment dispersion was dipersed in toluene to give a 6–9 weight percent dispersion. (AAA Yellow-6%, Lithol Rubine-6%, and G.S. Phthalo Blue-9%) The coating solutions were made by mixing one part of the pigment dispersion with two parts of the Chlorowax 70 solution. A #10 Meyer bar was used to coat the dispersion on a 6 micron polyethyleneterephthalate film. After air drying, the coated film was placed in an oven and dried for one minute at 60° C. The dry thickness coating was measured to be 1 micron. The coated sample was used to obtain an image on a PET receptor film using a thermal printer where a 200 dot/in. OKI printing head was used. Images obtained were clear and had 200 dots per inch resolution. Transmission optical density (TOD) was measured by a densitometer in a transmission density mode. Transparency was measured by using the densitometer in a reflection density mode with the appropriate filters and a black box to collect the transmitted light through the image. The reading is an inverse function of the scattered light. A higher number indicates less scattering and higher transparency.

Test results for each example are reported in Table III.

Transfer of the image was made at about 700 g/cm$^2$ on the thermal head.

TABLE III

| Color | Transfer Energy J/cm$^2$ | Transmission Optical Density | Transmission |
|---|---|---|---|
| Yellow | 2.0 | 1.01 | 1.59 |
| Magenta | 2.9 | 1.19 | 2.47 |
| Cyan | 2.0 | 2.26 | 2.39 |

EXAMPLE 2

In this example the pigment solutions have the same pigment to wax ratio of 1 to 2 as in example 1, except the chlorinated wax solution is mixture of Chlorowax 70 and Chlorowax 50. The addition of the low molecular weight Chlorowax 50 helped to reduce the transfer energy and maintained the high transparency of the final images. Sharp images with high resolution images on the PET copy sheet were obtained. Data on solid color patches is shown in Table IV. Wax solution volume ratios of the colorant coatings of Chlorowax 70 to Chlorowax 50 are indicated in the parenthesis.

TABLE IV

| Color | | Transfer Energy J/cm$^2$ | Transmission Optical Density | Transmission |
|---|---|---|---|---|
| Yellow | (7/1) | 1.7 | 0.83 | 1.77 |
| Magenta | (3/1) | 2.0 | 0.98 | 2.52 |
| Cyan | (7/1) | 1.7 | 2.21 | 2.47 |

EXAMPLE 3

Composite images were obtained by successive overprinting of more than one color to the same PET copy sheet. Low melting point beeswax was added to the colorant composition to improve color overprinting capability, but did not alter the pigment to the total wax content ratio. The addition of the low melting point beeswax increased the flow of the colorant layer to the copy sheet during transfer. The thickness of the coatings were also increased according to the sequence of printing. For the yellow coating a #7 Meyer bar was used, for the magenta coating a #8 Meyer bar was used, and for cyan coating a #14 Meyer bar was used. Weight ratios for the colorant coatings were yellow 6% in toluene, magenta 9% in toluene, and cyan 7% in toluene. The Chlorowax 70 and the low melting point beeswax were also at 6 weight percent in toluene. Coating thickness were varied for each color. Test results are shown below in Table V.

| | Sample preparation: | | |
|---|---|---|---|
| | Yellow | Magenta | Cyan |
| Flushed pigment | 1.00 | 1.00 | 1.00 |
| Chlorowax 70 | 1.50 | 1.33 | 1.67 |
| Beeswax | 0.50 | 0.67 | 0.33 |

TABLE V

| Color | Transfer energy J/cm$^2$ | (TOD) | Transmission | Coating Thickness (microns) |
|---|---|---|---|---|
| Yellow | 1.5 | 0.81 | 1.82 | 0.7 |
| Magenta | 1.5 | 1.59 | 2.31 | 0.8 |
| Cyan | 1.2 | 2.24 | 2.40 | 1.4 |

EXAMPLE 5

The same colorant donor sheets were used to make a composite image in a sequence of yellow, magenta, and cyan on a plain PET copy sheet film with the transfer energy set at 2.3 J/cm$^2$. Good overprint capability was demonstrated.

EXAMPLE 6

In this example it can be shown that index matching of the chlorinated wax to the pigment gives improved transparency to the transferred image. The formulation is essentially the same as in example 3 except the chlorinated wax and the beeswax are replaced by other waxes, such that they functionally performed equally well with the PET receptor as with the chlorinated wax donors.

| Sample preparation: | Magenta |
|---|---|
| Flushed pigment in toluene (6% in toluene) | 1.00 |
| Wax (6% in tolune) | 2.00 |

The following table shows the transparency comparison of the samples.

TABLE VI

| Transparency comparison: Sample | Magenta TOD | Transparency |
|---|---|---|
| Ink comp./Castor wax | 1.23 | 1.77 |
| Ink comp./Castor wax and Carnuba wax (.5/.5) | 1.18 | 2.09 |
| Ink comp./Cl-wax (Ex. 3) | 1.59 | 2.31 |

EXAMPLE 7

In this example color gradation capability of the donor will be demonstrated. The coating solutions have the same pigment to wax ratio of 1:2, as in examples 1 and 2, except the wax solution is a mixture of Chlorowax 70 and other waxes or polymer solution. The high concentration of pigments, and the low cohesiveness of Chlorwax 70 has enabled the thermal transfer of donor particles to an appropriate receptor. The transferred image has a continuous gradation optical density as a result of the continuous variation of energy input to the thermal printer. The following data was collected when plain PET was used as the receptor, and magenta flush was used as the ink composition. Gradation means the gradation at 32 input levels.

TABLE VII

| Wax mixture Gradation at | Voltage | TOD | Gradation |
|---|---|---|---|
| A:B ratio (3:1) | 9–14 v | 0–1.30 | 19 |
| A:B ratio (1:1) | 9–13 v | 0–1.00 | 17 |
| A:C ratio (3:1) | 10–16 v | 0–1.19 | 20 |
| A:C ratio (4:1) | 11–16 v | 0–1.62 | 17 |
| A | 13–17 v | 0–1.19 | 13 |
| A:D ratio (3:1) | 10–14 v | 0–1.56 | 16 |

(A is Chlorowax 70, B is Beeswax, C is Chlorowax 50, D is Elvax 210, an ethylene-vinylacetate copolymer).

The thermal printer was an OKI II thermal printer which has a power output of 0.27 watts/dot and 3 J/cm2 at a 18 v voltage output. The burntime was 2.5 msec. The gradation was calculated at the highest energy input required for maximum optical density with a 32 burn time equally spaced from 0–2.5 msec.

The following examples show the desirability of using mixtures of chlorinated waxes in the practice of the present invention. An important characteristic in selecting different chlorinated waxes is a difference of at least 10° C. in the melting point of the waxes. Blends of waxes seem to provide some definite improvements in performance characteristics of the transfer medium. In these examples, three different wax compositions were prepared for various color inks and their properties evaluated. The transfer sheets and the transferred images were variously evaluated for (1) the appearance of flow patterns on the image, (2) heat drag resistance, and (3) smudge resistance of the image. Smudge resistance was determined by measuring the initial optical density (ODi) and the final optical density (ODf) after 50 strokes with a cheesecloth using a Crockmeter. Smudge "loss" is defined as $$\frac{ODi - ODf}{ODi} \times 100\%$$

| | A | B | C |
|---|---|---|---|
| Flushed Pigments | 16.2 | 18.0 | 22 |
| Chlorez 760 | 37.4 | 40.0 | 25.0 |
| Cornauba Wax | — | — | 23.7 |
| Beeswax | 44.9 | — | — |
| Shellwax 70 | — | — | 16.9 |
| S. Candelilla wax | — | 31 | 10.1 |
| Acryloid A21 | — | — | 1.0 |
| Elvax 210 | — | 11 | 0.5 |
| Polyethylene Glycol Di-Stearate | 1.5 | — | — |
| Ester 10 | — | — | 0.5 |

Hand spread samples were made on 6 micron polyethylene terephthalate film using a No. 16 Meyer bar. All formulations were first diluted to 7.5% by weight in toluene.

Chlorowax 70 is a chlorinated paraffin wax having a chlorine content of 70% by weight, specific gravity of 1.66, melting point of 102° C. (ball and ring), refractive index at 25° C. of 1.535 and a molecular weight of 1073.

Chlorez 760 is a chlorinated paraffin wax having a chlorine conteng of 74% by weight, specific gravity of 1.7, and a melting point of 160° C. (ball and ring).

Acryloid 21 is an acrylic particulate.

The comparative properties for the three systems using flush pigments as colorants are shown in Table VIII.

TABLE VIII

| | A | B | C |
|---|---|---|---|
| Print Energy (J/cm$^2$) | 1.3–1.6 | 1.6–1.8 | 1.8–1.21 |
| Print Pressure (kg/cm$^2$) | 0.47 | 0.47–4.7 | ~4.7 |
| Coating Temp. (°C.) | 25 | 25 | 47.5 |
| Transferred Optical Density | | | |
| Yellow | 0.72 | 0.65 | 0.76 |
| Magenta | 0.77 | 1.10 | 1.20 |
| Cyan | 0.98 | 1.89 | 1.42 |
| Red | | 0.94 | 1.20 |
| Green | | 1.76 | 1.52 |
| Blue | | 1.69 | 1.46 |
| Black | | 1.50 | 1.43 |

EXAMPLE 9

Three additional compositions were prepared for comparison. The amounts shown in weight percent.

| | D | E | F |
|---|---|---|---|
| Pigment | | | |
| Pigment | 20 | 8.8 | 13.0 |
| Paraffin wax | | 13.2 | — |
| Chlorinated Paraffin (Chlorowax 70) | — | | 13.0 |
| Carnauba Wax | 20 | 23.7 | 24.3 |
| S. Candelilla | — | 10.1 | 10.4 |
| Ester wax 40 (a mixture of non-chlorinated esterified waxes) | — | — | |
| Shell wax 700 | — | 16.9 | 17.4 |
| Mineral oil | 10 | — | — |
| Inert fill | 10 | — | — |
| Chlorez 760 | — | 25.3 | 13.0 |
| Acryloid 21 | — | 1.0 | 1.0 |
| Ester 10 | — | 0.5 | 0.6 |

-continued

| | D | E | F |
|---|---|---|---|
| Elvax 210 | — | 0.5 | 7.3 |

The performance characteristic comparison of the compositions is shown in Table IX after formulations E and F were diluted to 7.5% by weight with toluene and hand spread samples were made as in Example 8.

TABLE IX

| | D | E | F |
|---|---|---|---|
| Transfer energy (J/cm$^2$) | 1.6–2 | 1.8–2.1 | 1.8–2.1 |
| Resolution (dots/cm) | ~76 | >80 | >80 |
| Transfer Optical Density | | | |
| Yellow | 0.64 | 0.76 | 0.67 |
| Magenta | 0.55 | 1.20 | 1.08 |
| Cyan | 0.75 | 1.42 | 1.20 |
| Red | 0.82 | 1.20 | 1.05 |
| Green | 0.80 | 1.52 | 1.20 |
| Blue | 0.81 | 1.46 | 1.22 |
| Black | 0.98 | 1.43 | 1.39 |
| Flow Patterns (solid areas) | Yes | No | No |
| Heat Drag Resistance | Poor | Fair | Good |
| Smudge Resistance (loss) | 26% | 20% | — |

What is claimed:

1. A thermal transfer donor article comprising a non-porous substrate having coated thereon a transparent ink layer, said ink layer comprising a chlorinated wax binder and a colorant, said chlorinated wax comprising the greatest proportion of said binder in said ink layer said chlorinated wax having a chlorine content of at least 40% by weight chlorine, a softening point above 100° C., and a molecular weight of at least 500, said colorant being finely dispersed in said wax and having an average particle diameter of less than 0.8 microns said indices of refraction of said chlorinated wax binder and said colorant being sufficiently close as to provide transparency in said ink layers.

2. The article of claim 1 wherein said chlorinated wax has a softening point between 110° C. and 200° C.

3. The article of claim 2 wherein the refractive indices of the colorant and the wax binder are within 0.50 of each other.

4. The article of claim 3 wherein said chlorinated wax has a molecular weight of between 500 and 2000.

5. The article of claim 2 wherein and chlorinated wax comprises 40–75% chlorine.

6. The article of claim 5 wherein said chlorinated wax has a molecular weight of between 500 and 2000.

7. The article of claim 5 in which said clorinated wax comprises a blend of two different chlorinated waxes, one having a melting point at least 10° C. higher than the melting point of the other.

8. The article of claim 2 wherein said chlorinated wax has a molecular weight of between 500 and 2000.

9. The article of claim 1 wherein the refractive indices of the colorant and the wax binder are within 0.15 of each other.

10. The article of claim 9 wherein and chlorinated wax comprises 40–75% chlorine.

11. The article of claim 10 in which said clorinated wax comprises a blend of two different chlorinated waxes, one having a melting point at least 10° C. higher than the melting point of the other and said colorant having an average particle size of less than 0.5 microns.

12. The article of claim 9 wherein said chlorinated wax has a molecular weight of between 500 and 2000.

13. The article of claim 1 wherein said chlorinated wax comprises 40–75% chlorine.

14. The article of claim 13 wherein said chlorinated wax has a molecular weight of between 500 and 2000.

15. The article of claim 1 wherein said chlorinated wax has a molecular weight of between 500 and 2000.

16. The article of claim 1 in which said clorinated wax comprises a blend of two different chlorinated waxes, one having a melting point at least 10° C. higher than the melting point of the other.

* * * * *